US005092743A

United States Patent [19]

Dietrich

[11] Patent Number: 5,092,743

[45] Date of Patent: Mar. 3, 1992

[54] PNEUMATICALLY CONTROLLED PUMP

[75] Inventor: Frédéric F. Dietrich, Les Paccots, Switzerland

[73] Assignee: Ecot S.A., Fribourg, Switzerland

[21] Appl. No.: 593,792

[22] Filed: Oct. 5, 1990

[30] Foreign Application Priority Data

Oct. 6, 1989 [CH] Switzerland ..... 3661/89

[51] Int. Cl.[5] ..... F04F 1/06; F04B 9/12; F04B 17/00

[52] U.S. Cl. ..... 417/392; 417/384; 417/126; 417/130; 417/131

[58] Field of Search ..... 417/384, 392, 126, 130, 417/131, 900, 149, 148

[56] References Cited

U.S. PATENT DOCUMENTS

| | | | |
|---|---|---|---|
| 1,816,025 | 7/1931 | Sablik . | |
| 3,556,682 | 8/1968 | Sakamoto et al. | 417/126 |
| 3,882,899 | 5/1975 | Ginsberg et al. . | |
| 4,547,132 | 10/1985 | Uchida et al. | 417/900 |
| 4,548,550 | 10/1985 | Tsuji | 417/394 |
| 4,653,989 | 3/1987 | Mason | 417/392 |

FOREIGN PATENT DOCUMENTS

| | | | |
|---|---|---|---|
| 8620319 | 7/1986 | Fed. Rep. of Germany . | |
| 824474 | 2/1938 | France . | |
| 1380748 | 10/1964 | France . | |
| WO81/01447 | 5/1981 | PCT Int'l Appl. | 91/50 |
| 937023 | 9/1963 | United Kingdom . | |
| 1345627 | 1/1974 | United Kingdom . | |

*Primary Examiner*—Richard A. Bertsch
*Assistant Examiner*—Alfred Basichas
*Attorney, Agent, or Firm*—Oliff & Berridge

[57] ABSTRACT

A pump of extremely simple manufacture, requiring no maintenance, is made up of a tubular body (1) closed at each end by end pieces (10*a* and 10*b*), orifices (15*a* and 15*b*) of which are respectively connected to a pneumatic control circuit (4) and to the circuit of liquid in circulation (3). A piston (2) circulates freely within the tubular body, driven by an overpressure or an underpressure appearing in the upper chamber (17*a*) and controlled by the pneumatic control circuit. The displacement of the piston brings about the filling and emptying of the lower chamber (17*b*), thus permitting the pumping of a liquid. This type of pump, of universal use, needs only a connection to a compressor (40) and to a vacuum pump (41) for its running, and these two elements may be common to a great number of such pumps.

7 Claims, 4 Drawing Sheets

PNEUMATICALLY CONTROLLED PUMP

This invention relates to pumps, and more particularly to a pump for liquids, of the type comprising a body formed of a cylindrical tube connected at one of its ends to a pneumatic control circuit, and the other end of which is connected to the circuit of liquid to be pumped.

On numerous occasions there is a need for pumps in industry, for pumping, decanting, or moving the most varied liquids; generally, such pumps are composed of a pumping element proper, associated with an electric motor in the form of a single unit or of separate components. In the chemical industry in particular, according to the equipment used, it may happen that a large number of pumps are required, thus necessitating an equivalent number of driving motors. This leads to a high cost of the installation owing to the large number of necessary motors, all the more so if these motors, operating in an explosive atmosphere, have to be specially protected against the appearance of sparks.

A pneumatic control of the pump in question is therefore especially favorable for such use; various designers have proposed pneumatically actuated pumps, in particular: West German Utility Model No. 8,620,319 describes a pneumatically controlled pump, the piston of which comprises three annular gaskets separating the driving fluid from the conveyed fluid; moreover, control of the intake and discharge valves takes place independently of the position of the piston in the cylinder.

U.S. Pat. No. 1,816,025 describes a system comprising two pump bodies, each provided with a float, and operating alternately. Each float acts upon the air admission and exhaust valves via guide-rods.

French Patent No. 824,474 relates to a pump in which the position of a float controls the air admission and exhaust valves via a set of levers.

French Patent No. 1,380,748, like the preceding patent, mentions that the float acts only as a level detector.

U.K. Patent No. 1,345,627 relates to a pump for feeding a motor, controlled by the gases of the motor, but the piston of which is provided with gaskets for fluidtightness relative to the chamber.

It is an object of this invention to provide an improved pump for liquids which, powered by a pneumatic control circuit, may therefore be connected directly to the pneumatic circuits of the factory, or else to its own pneumatic circuits, thus having no need for its own driving motor.

A further object of this invention is to provide a pump which, by virtue of an extremely simple modular design, comprises only a single moving part, the piston, and which further causes the opening and closing of the admission and delivery circuits of the control air as well as of the liquid to be decanted.

Still another object of the invention is provide a pump which does not exhibit the aforementioned drawbacks of prior art pumps.

To this end, in the pump according to the present invention, of the type initially mentioned, the improvement comprises a floating piston circulating freely within the tube, driven by an overpressure and an underpressure, respectively, coming from the pneumatic circuit, the piston comprising a circular joint on each of its faces, intended to block alternatively either the pneumatic control circuit or the circuit of liquid to be pumped.

It is easy to select the constituent materials according to the degree of corrosiveness of the liquid to be circulated; and since the power source is decentralized, it is not necessary to take any special precautions when the pumps are situated in an explosive atmosphere. These advantages make possible a considerable reduction in the cost of installation, and even of operation, of a production unit using a large number of pumps.

Preferred embodiments of the invention and of its mode of operation will now be described in detail with reference to the accompanying drawings, in which.

Figure 1:
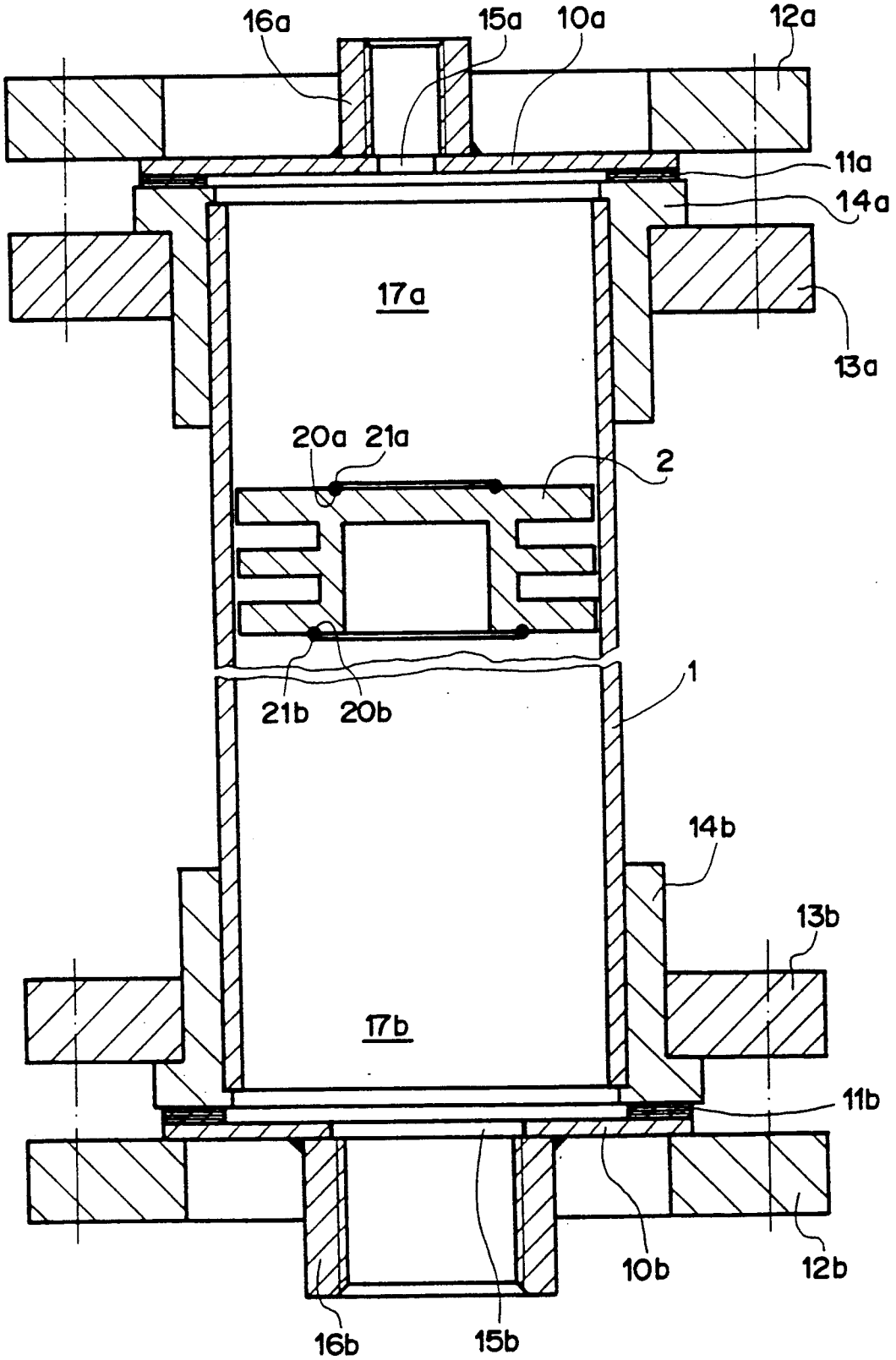
FIG. 1 is a sectional view of a first embodiment of the inventive pump.

As may be seen in FIG. 1, the pump is composed of an elongated tubular body 1, preferably but not necessarily of circular cross-section, in which a piston 2 circulates freely along the longitudinal axis of body 1, this axis being vertical. Body 1 is closed at the top and bottom by end pieces 10*a* and 10*b* fixed to tubular body 1 by any means suited to the constituent materials of both body 1 and pieces 10*a* and 10*b*. FIG. 1 shows an example of a fastening system which may be used when a tubular body 1 is of synthetic material, where end pieces 10*a* and 10*b* press against gaskets 11*a*, 11*b* and are squeezed by means of bolts (not shown) between two rings 12*a* and 13*a*, 12*b* and 13*b*, respectively, against a support 14*a*, 14*b* fixed to body 1. When body 1 is of metal, end pieces 10*a* and 10*b* may be secured to it by welding or by any other mean ensuring fluidtightness. End piece 10*a* is pierced in the center by an orifice 15*a* opening into an adapter 16*a* connected to the pneumatic circuit. Adapter 16*a* is secured to end piece 10*a* by any appropriate means, e.g., by welding.

Analogously, an adapter 16*b* is secured to end piece 10*b*, pierced by an orifice 15*b*, adapter 16*b* being connected to the circuit of the circulating liquid. The diameters of orifices 15*a* and 15*b* may be of any size but are adapted to the diameter of the pipes of both the pneumatic circuit and the liquid flow circuit to which they are connected; usually, the diameter of orifice 15*b* will be greater than that of orifice 15*a*.

Piston 2 is of dimensions such that it may slide very freely within tubular body 1; when the latter is of circular shape, the diameter of piston 2 will therefore be slightly less than the inside diameter of body 1 so as to leave a certain clearance between piston 2 and the wall of body 1. The height of piston 2 will have to be sufficient so that it is suitably guided within body 1. Piston 2 is shown in FIG. 1 as consisting of a cylinder having a number of indentations made in its outside wall and a recess in the bottom. These indentations and recess play no part in the operation of the pump but simply make it possible to save on material. Piston 2 includes two circular grooves 20*a* and 20*b*, one on its top face and the other on its bottom face, in which respective circular gaskets 21*a* and 21*b* are seated, e.g., O-rings.

Within tubular body 1, piston 2 bounds an upper chamber 17*a* and a lower chamber 17*b*, the upper chamber extending toward end piece 10*a* and the lower toward end piece 10*b*. Through orifice 15*a* and adapter 16*a*, upper chamber 17*a* is connected to the pneumatic control circuit, while lower chamber 17*b* is connected through orifice 15*b* and adapter 16*b* to the liquid flow circuit. The displacement of piston 2 within tubular body 1 will therefore be controlled by the difference in pressure between chambers 17*a* and 17*b*; in other words, when piston 2 has been moved toward end piece 10*b* by an overpressure in chamber 17*a* coming from the pneumatic circuit, it blocks orifice 15*b* completely and fluidtightly by means of its circular gasket 21*b*, thus preventing the penetration of liquid into body 1. By reducing the air pressure in chamber 17*a*, by means to be specified below, so as to make that pressure less than the pressure prevailing in the liquid flow circuit and, consequently, than that prevailing in chamber 17*b*, piston 2 will have a tendency to lift off end piece 10*b* and to move toward end piece 10*a*. Inasmuch as the material of which piston 2 is made has a specific gravity less than that of the liquid to be circulated, piston 2 will float above the liquid and will reach piece 10*a* before the liquid so as to block orifice 15*a* fluid-tightly, by means of circular gasket 21*a*, before the liquid reaches it. In this case, chamber 17*b* occupies its maximum volume, this volume being filled with liquid. It then suffices to re-establish sufficient pressure in the pneumatic circuit to push piston 2 back toward end piece 10*b* in order to force the liquid into its flow circuit and return to the preceding starting situation.

Figure 2:
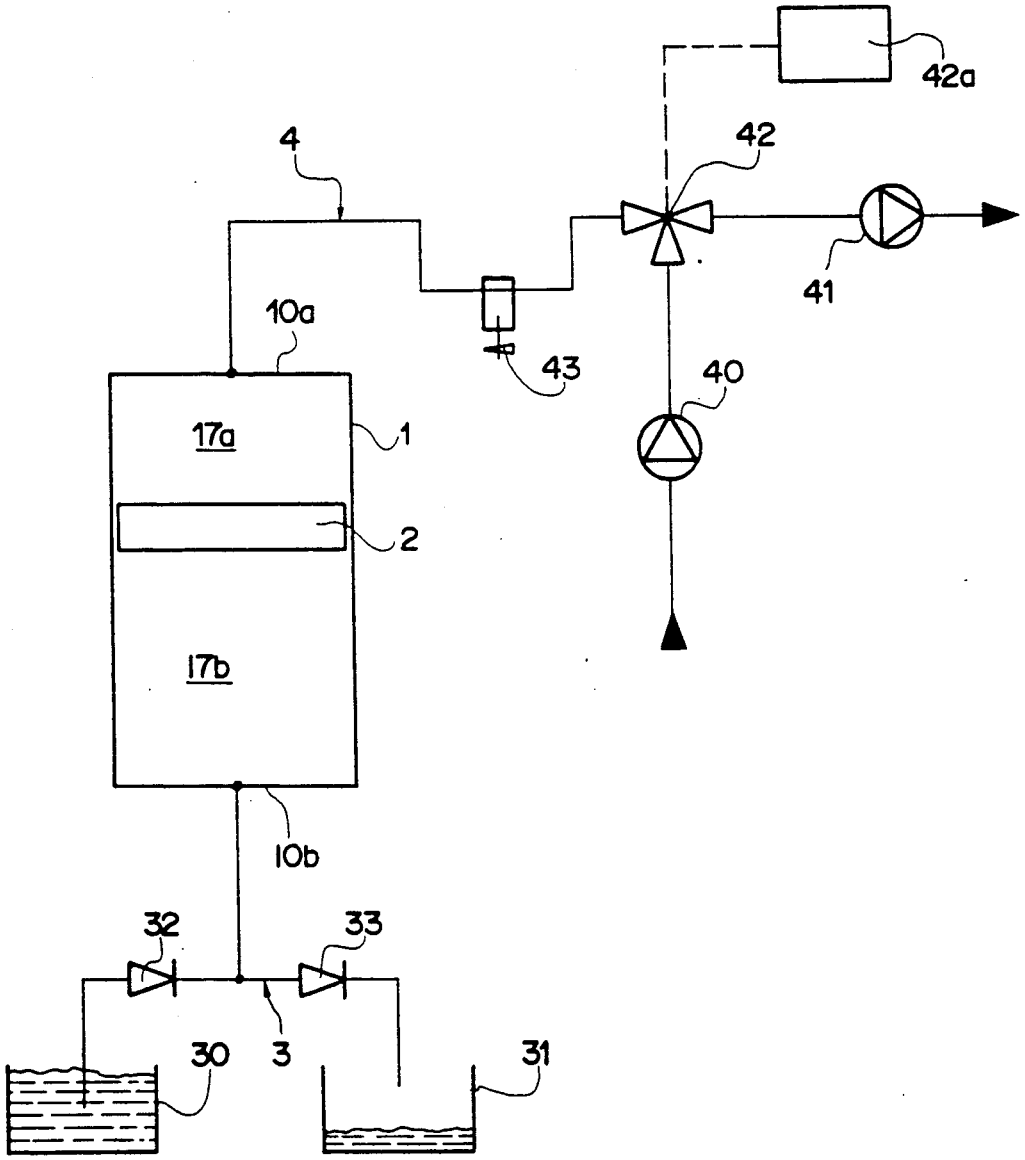
FIG. 2 is a diagram showing a pump, its pneumatic control circuit, and an example of a liquid flow circuit.

The operation of the pump will be understood even more clearly with reference to FIG. 2, a diagram in which the pump is shown in an application of decanting a liquid from a tank 30 into another tank 31. A pneumatic control circuit 4 comprises chiefly a compressor 40 and a vacuum pump 41 connected to upper chamber 17*a* through a three-way valve 42 controlled by a suitable control device 42*a* which may be mechanical, electrical, electronic, pneumatic, or hydraulic. Control device 42*a* acting upon three-way valve 42 is responsible for connecting successively either compressor 40, in order to create overpressure in chamber 17*a*, thus pushing piston 2 downward and forcing the liquid into its flow circuit 3, or vacuum pump 41, thus reducing the pressure in chamber 17*a* and drawing piston 2 together with the liquid into chamber 17*b*. Control device 42*a* regulates the speed at which piston 2 rises in tubular body 1 in such a way that the liquid remains in contact with the bottom face of piston 2, and no cavitation phenomenon is produced in chamber 17*b*. By means of a retention device provided with a drain-cock 43 interposed between pump 41 and three-way valve 42, any vapor or droplets of liquid are retained so as not to be drawn in by pump 41. In order that decanting or the circulation of the liquid may take place in the desired direction, two check valves 32 and 33 are provided on liquid flow circuit 3; check valve 33 further makes it possible to avoid having air drawn into circuit 3.

Figure 3:
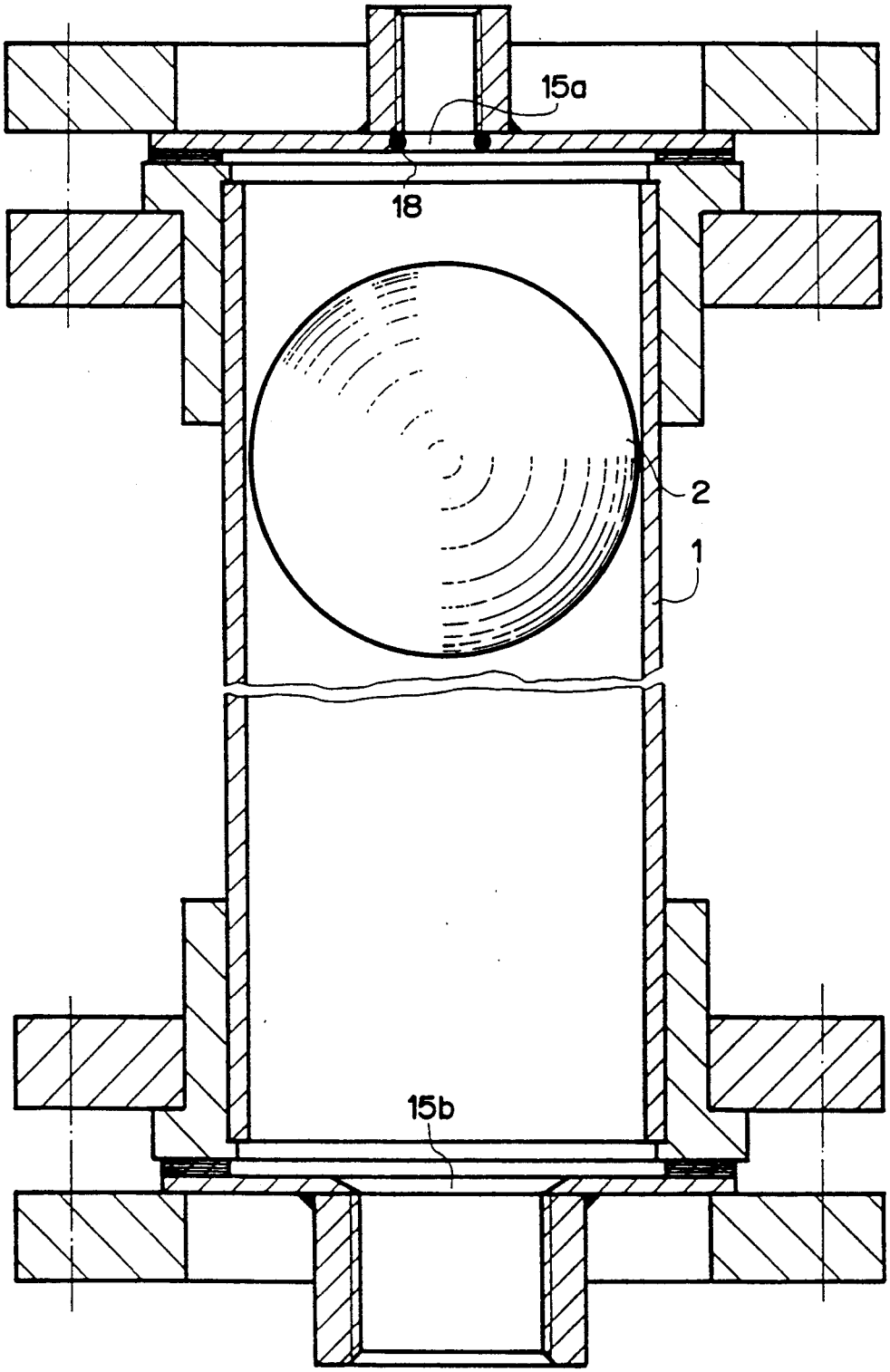
FIG. 3 is a sectional view of another embodiment of the inventive pump.

FIG. 3 shows a pump similar to that of FIG. 1, but having a spherical piston 2 which may be solid or hollow like a ping-pong ball, for instance, the only restrictions being, as before, that the diameter of the sphere be slightly less than that of tubular body 1 and that the specific gravity of the sphere be less than that of the liquid. In this embodiment, the fluid-tightness arrangements between orifices 15*a* and 15*b* and piston 2 are transferred to the orifices. FIG. 3 illustrates two possible designs: either a toroid joint 18 is disposed directly upon orifice 15*a*, or orifice 15*b* has a shape such that spherical piston 2 comes to rest exactly upon it in order to block it. This drawing figure presents two possible modifications of the means for ensuring fluid-tightness shifted to the orifices. It will be understood that further modifications are possible and that the two orifices ma be equipped with either the same type of device or two different devices.

The inventive pump is described above in connection with the decanting of a liquid. However, it may obviously be applied to many other uses. Generally speaking, this type of pump may be utilized as a suction pump, a force pump, a lift and force pump, and a circulation pump, its application in one or the other of these categories being effected by a judicious choice of the pneumatic overpressure and underpressure controlling the movement of the piston. To this end, FIG. 2 shows the pump equipped with a compressor and a suction pump; in the case of an application comprising a plurality of pumps, these two elements may be common to the whole set of pumps or even, in certain cases, take the form of the factory's own compressed-air and suction circuits. Additionally, when a plurality of pumps are used, a plurality of devices for selectively producing positive and negative pressure can be provided, with the number of devices being less than the number of pumps. If no negative pressure is necessary for operation, the suction pump might even be eliminated, the respective airway of the three-way valve then opening out into an atmospheric pressure port.

The constituent materials of the pump elements will be chosen as a function of the contemplated application and should particularly be resistant to corrosion by the liquid to be conveyed and/or to the temperature thereof. The tubular body will preferably be of synthetic material, or if it is necessary to have a metal body, then stainless steel may be used, for example, the piston preferably being of synthetic material; the end pieces, the adapters, the gaskets, and the fastening systems will also be chosen to resist the action of the liquid and to be capable of being assembled with one another and with the tubular body.

As has been seen, the design of a pump according to the present invention is extremely simple, needing no rotary part nor any great machining precision. Since the only moving part is the piston, which has a very loose contact with the tubular body and is constantly "lubricated" by the liquid, this will facilitate maintenance of the pump inasmuch as it will not be subject to any wear and tear.

The fields of application of such pumps are myriad, particularly in the chemical, dyestuff, and food industries, as well as many others. Owing to the fact that the lower chamber has a specific given volume, it is possible to use a pump of this type as a metering pump, the control of the three-way valve then being programmed to control a certain number of filling-and-emptying cycles of the lower chamber in order to convey a specific volume of liquid. The viscosity of the liquid to be conveyed does not play any part in the operation of the pump since the speed of displacement of the piston can be regulated by the speed of creation of the vacuum and of the overpressure in the upper chamber. In the case of very viscous liquids, apparatus for the pumping and transfer of products of any viscosity as described in Swiss Patent No. 647,145 may be used to supplement the installation and to aid in conveying the liquid.

Figure 4:
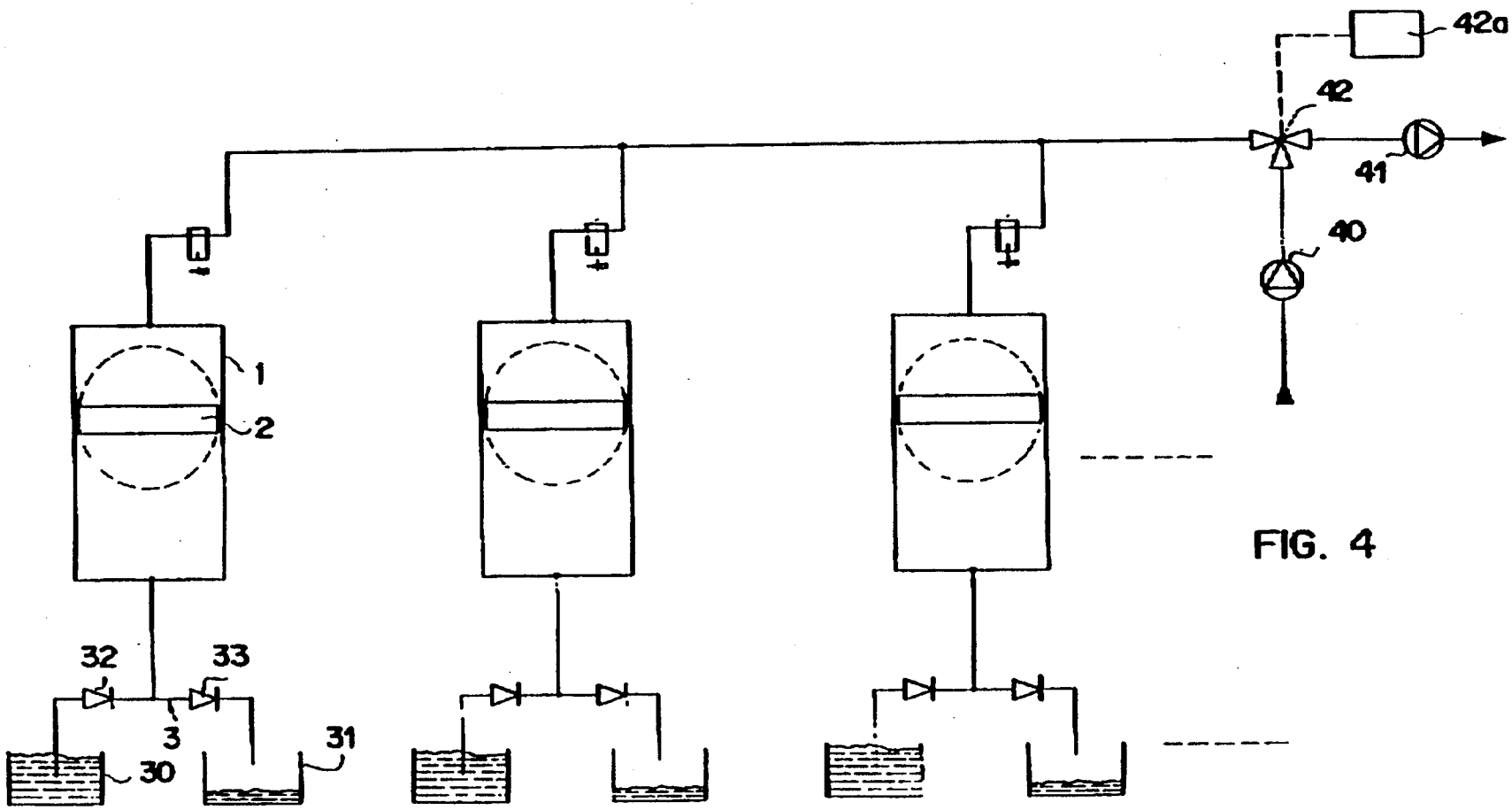
FIG. 4 is a diagram showing an installation comprising a plurality of pumps, corresponding to the embodiments of FIG. 1 or FIG. 3, with only one device for producing positive and/or negative pressure.

Hence the pump according to the present invention, having a very low basic cost and needing no particular maintenance, is adaptable to all sorts of applications, particularly those requiring a large number of pumps, a tangible saving being due to the fact that the power source is common to all the pumps, as shown in FIG. 4. Since this power source is decentralized, and since there is no risk of sparks appearing near the pumps, they can operate in an explosive atmosphere without additional precautions.

What is claimed is:

1. A pump for pumping a liquid, of the type having a body in the form of a cylindrical tube, a pneumatic control circuit connected to one end of said tube for selectively producing positive and negative pressures within said tube, and means for connecting the other end of said tube to a circuit containing the liquid to be pumped, wherein the improvement comprises:

a floating piston freely movable within said tube, having two end faces, and adapted to be driven by said positive and negative pressures, and two circular gaskets respectively disposed on said two end faces for selectively blocking either said pneumatic control circuit or said circuit containing the liquid to be pumped.

2. The pump of claim 1, wherein said piston is made of a material having a specific gravity less than that of the liquid to be pumped.

3. The pump of claim 1, wherein said piston is spaced from the inside wall of said tube.

4. The pump of claim 1, further comprising sequential control means for actuating said pneumatic control circuit.

5. A pumping arrangement comprising a plurality of pumps according to claim 1, and at least one device, less in number than a number of said plurality of pumps, for selectively producing positive and negative pressure.

6. A pump for pumping a liquid, of the type having a body in the form of a cylindrical tube, a pneumatic control circuit connected to one end of said tube for selectively producing positive and negative pressures within said tube, and means for connecting the other end of said tube to a circuit containing the liquid to be pumped, wherein the improvement comprises:

said one end of said tube having a first circular orifice;

said means for connecting having a second circular orifice; and a spherical floating piston freely movable within said tube, adapted to be driven by said positive and negative pressures, and able to close alternatively said first orifice and said second orifice, and made of a material having a specific gravity less than that of the liquid to be pumped.

7. A pumping installation comprising a plurality of pumps at least one device, less in number than a number of said plurality of pumps, for selectively producing positive and negative pressure.

* * * * *